US006492765B1

(12) United States Patent
Yamagishi

(10) Patent No.: US 6,492,765 B1
(45) Date of Patent: Dec. 10, 2002

(54) CATHODE STRUCTURE FOR CATHODE RAY TUBE

(75) Inventor: Mika Yamagishi, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/830,444

(22) PCT Filed: Oct. 25, 1999

(86) PCT No.: PCT/JP99/05887

§ 371 (c)(1),
(2), (4) Date: Apr. 25, 2001

(87) PCT Pub. No.: WO00/25338

PCT Pub. Date: May 4, 2000

(30) Foreign Application Priority Data

Oct. 28, 1998 (JP) ..... 10-306590

(51) Int. Cl.[7] ..... H01J 1/20; H01J 29/04
(52) U.S. Cl. ..... 313/346 DC; 313/337
(58) Field of Search ..... 313/346 DC, 337, 313/270, 346 R

(56) References Cited

U.S. PATENT DOCUMENTS 5,072,149 A * 12/1991 Lee et al. ..... 313/346 R
5,347,194 A * 9/1994 Derks ..... 313/346 R
6,124,667 A * 9/2000 Komiya et al. ..... 313/346 R
6,181,058 B1 * 1/2001 Lee ..... 313/346 R

FOREIGN PATENT DOCUMENTS

| | | |
|---|---|---|
| JP | 6-165021 | 8/1985 |
| JP | 5-174701 | 7/1993 |
| JP | 5-334954 | 12/1993 |
| JP | 7-44048 | 10/1995 |

* cited by examiner

*Primary Examiner*—Ashok Patel
(74) *Attorney, Agent, or Firm*—Merchant & Gould P.C.

(57) ABSTRACT

In a cathode with an electron-emissive material layer formed on a base containing a reducing element, a relationship of $0.24 \leqq B/A \leqq 0.93$ is satisfied, where A denotes a surface for layer formation of the base and B represents an area where the base and the electron-emissive material layer are in contact with each other. In addition, a relationship of $0.4 \leqq D/C \leqq 0.7$ is satisfied, where C and D denote thicknesses of the base and the electron-emissive material layer, respectively. Thus, a cathode structure is provided in which sufficient electron emission can be obtained, a decrease in electron emission with the passage of time is not much during the operation, and variations in cut-off voltage are small.

6 Claims, 8 Drawing Sheets

CATHODE STRUCTURE FOR CATHODE RAY TUBE

TECHNICAL FIELD

The present invention relates to a cathode structure provided in an electron gun of a cathode-ray tube used in a television, a computer monitor, or the like.

BACKGROUND ART

As shown in FIG. 2, a cathode-ray tube 1 includes a faceplate portion 3 having a phosphor screen 2 on its inner face, a funnel portion 4 bonded at the rear of the faceplate portion 3, and an electron gun 6 for emitting electron beams 5 placed inside a neck portion 7 of the funnel portion 4.

An indirectly heated cathode structure 108 is provided at an end of an electron gun. As shown in FIG. 8, in the cathode structure 108, one end of a cylindrical sleeve 109 is covered with a cap-like base 110, and an electron-emissive material layer 111 is formed on the surface of the base 110. The electron-emissive material layer 111 is formed of an electron emitter for emitting thermoelectrons. A coiled heater 115 is provided inside the cylindrical sleeve 109 and includes an alumina electrical insulating layer 113 on a metal-wire coil 112 and a dark layer 114 as an upper layer thereof. Generally, the electron-emissive material layer 111 is formed on the whole base surface 120 facing an electron emitting side.

A cathode structure also has been proposed in which an electron-emissive material layer containing alkaline-earth metal or the like is allowed to adhere only to the center portion of a base surface by spraying or the like (JP 5(1993)-334954 A). In this cathode structure, the electron-emissive material layer located at the periphery, which does not participate much in electron emission, is omitted, so that the heat from a heater can be absorbed efficiently by the electron-emissive material layer.

In a step of activating a cathode, a reducing element (for instance, magnesium, silicon, or the like) contained in the base diffuses thermally to the interface between the electron-emissive material and the base, reduces the electron-emissive material (whose main component is an alkaline earth oxide such as barium oxide), and thus produces free barium. This enables electron emission. This reductive reaction is expressed by the following equations:

$$2\,BaO+1/2\,Si=Ba+(1/2)Ba_2SiO_4$$

and $$BaO+Mg=Ba+MgO.$$

In the conventional cathode structure described above, however, there have been problems in that sufficient electron emission cannot be obtained at an initial activating step and a decrease in electron emission during operation with the passage of time is worsened. In addition, there also has been a problem in that excessive shrinkage of the electron-emissive material layer is caused during operation due to the progress of the reductive reaction and this increases variations in cut-off voltage (electron beam erase voltage) inversely proportional to the distance between a counter electrode and the electron-emissive material.

DISCLOSURE OF THE INVENTION

According to the investigation by the present inventor, from an entirely different viewpoint from the improvement in thermal efficiency as described in JP 5(1993)-334954 A, it was found that the above-mentioned reductive reaction progressed suitably when the amount of the electron-emissive material and the size of the base were adjusted to satisfy predetermined relationships and thus the above-mentioned problems were solved.

The present invention is intended to provide a cathode structure with characteristics improved by optimization of the relationship between the sizes of a base and an electron-emissive material layer.

An embodiment of a cathode structure according to the present invention is a cathode structure for a cathode-ray tube having an electron-emissive material layer formed on a base containing a reducing element. The cathode structure is characterized by satisfying the relationship of $0.24 \leqq B/A < 0.93$, wherein A denotes an area of a surface for layer formation of the base and B represents an area where the base and the electron-emissive material layer are in contact with each other, and having a zero-electric-field saturation current density of at least 6.4 A/cm$^2$ after an implementation of an accelerated life test for 5000 hours under conditions of a vacuum of $10^{-7}$ mmHg, a cathode temperature of 820° C., and a current led out from a cathode of DC 300 $\mu$A.

In this context, the surface for layer formation of the base refers to the surface of the base facing the electron emission side and does not include side faces of the base. When the surface for layer formation has a circular shape, the area of this surface can be determined by a formula of $\Pi(d/2)^2$ based on its diameter d.

According to this cathode structure, a practically sufficient cathode current can be obtained even after long-term use, and in addition, the variations in initial cathode current among cathodes can be reduced considerably. When the size of the base is determined, the size of the electron-emissive material layer required for a practical operation can be determined easily.

Furthermore, another embodiment of a cathode structure of the present invention is a cathode with an electron-emissive material layer formed on a base containing a reducing element. The cathode is characterized by satisfying the relationships of $0.24 \leqq B/A \leqq 0.93$ and $0.4 \leqq D/C \leqq 0.7$, wherein A denotes an area of a surface for layer formation of the base, B an area where the base and the electron-emissive material layer are in contact with each other, C the thickness of the base, and D the thickness of the electron-emissive material layer. This cathode structure has a long life and allows variations in cut-off voltage to be reduced.

EMBODIMENT OF THE INVENTION

A preferred embodiment of the present invention is described with reference to the drawings.

Figure 1:
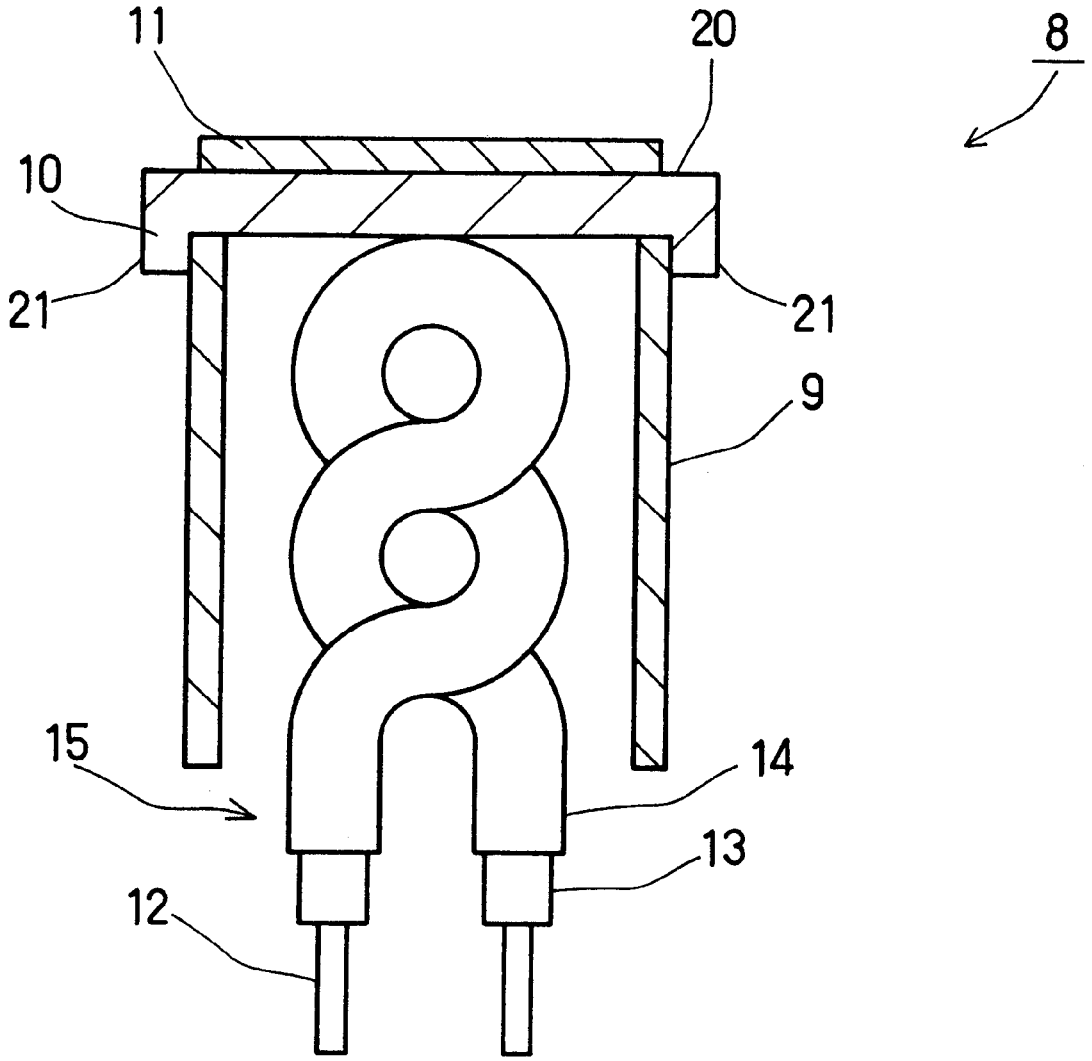
FIG. 1 is a sectional view of an embodiment of a cathode structure according to the present invention.
Figure 2:
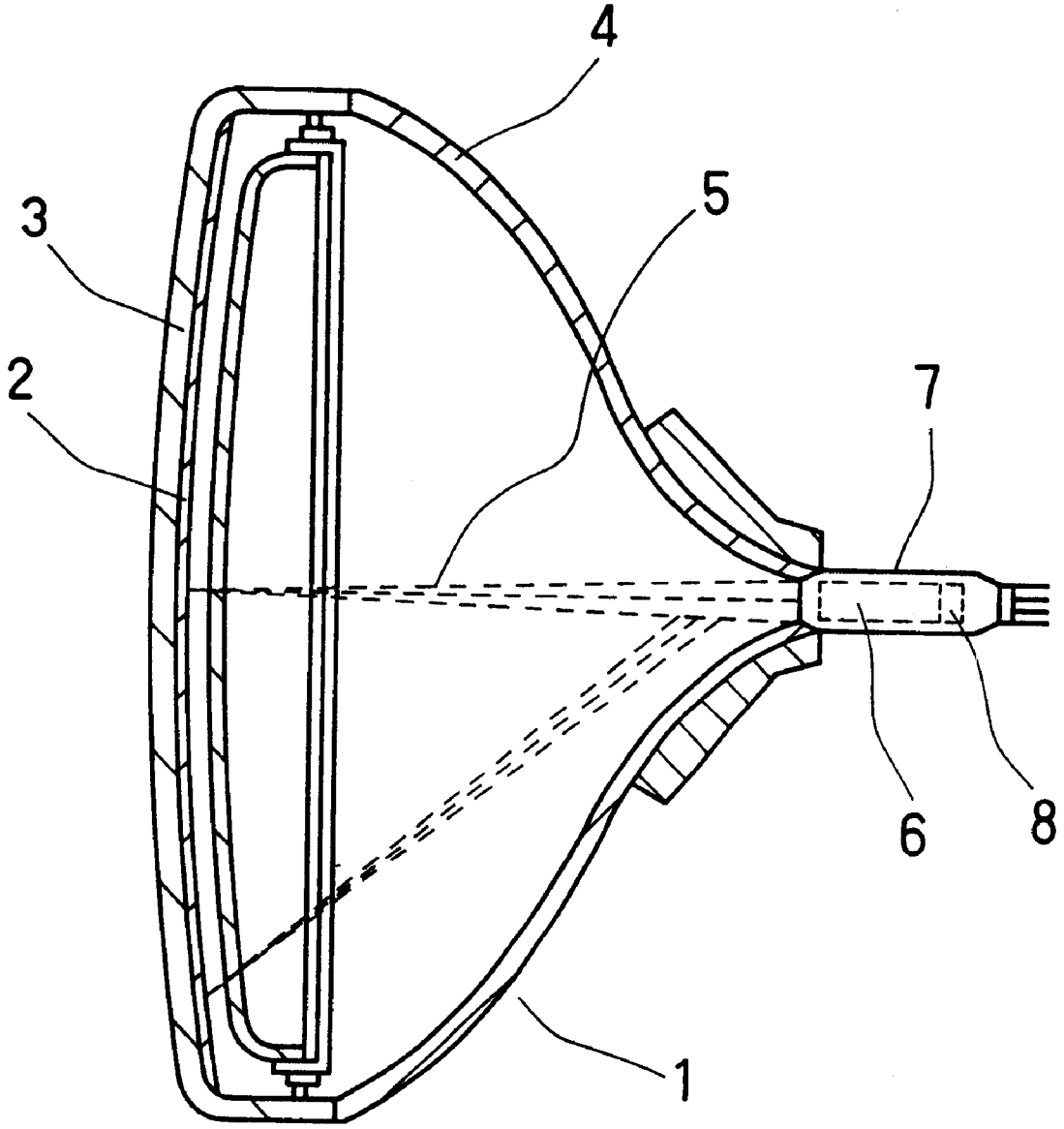
FIG. 2 is a sectional view showing an example of a cathode-ray tube.

As shown in FIG. 1, in a cathode structure 8 according to a cylindrical sleeve 9 to cover one end of the sleeve 9. An electron-emissive material layer 11 formed of an electron emitter for emitting thermoelectrons is formed on an upper surface (a surface for layer formation) 20 of the base 10. A coiled heater 15 is provided inside the cylindrical sleeve 9 and has an alumina electrical insulating layer 13 on a metal-wire coil 12 and a dark layer 14 as an upper layer thereof.

The base 10 contains nickel as a main component and a reducing element such as magnesium, silicon, or the like. Tungsten, aluminum, or the like may be used as the reducing element as well.

A ratio B/A is in the range of 0.24 to 0.93, wherein A denotes the area of the upper surface 20 of the base and B the area where the base 10 and the electron-emissive material layer 11 are in contact with each other. In addition, a ratio D/C is in the range of 0.4 to 0.7, wherein C and D denote the thickness of the base 10 and that of the electron-emissive material layer 11. In this case, the area A refers to the area of the upper surface 20 facing the electron emission side excluding that of side faces 21 of the base 10.

The control of the ratios B/A and D/C within the above-mentioned value ranges makes it possible to achieve good performance sufficient for a normal operation under a zero-electric-field saturation current density of at least 6.4 A/cm$^2$ and a cut-off voltage of not higher than 85% of an initial value after an elapse of 5000 hours in an accelerated life test as described later.

An example of a method of forming the electron-emissive material layer 11 is described. Initially, powder whose main component is alkaline earth metal carbonate is dissolved into an organic solvent containing 85% diethyl carbonate and 15% nitric acid. Thus, a mixed application liquid (a resin solution) is prepared. The powder contains at least barium carbonate and at least one of strontium and calcium. Preferably, for example, the ratio of a content of barium carbonate to that of strontium carbonate is set to be 1:1 on a weight percent basis.

Next, this mixed application liquid is applied to the surface 20 of the base 10 by spraying. The spraying is carried out with a frame (not shown in the figure), having an opening corresponding to a predetermined portion to which an electron-emissive material is to be applied, placed on the base 10, so that the electron-emissive material layer 11 can be formed on the predetermined portion only. The thickness of the electron-emissive material layer 11 can be controlled through an adjustment of the spraying time.

The thickness of the electron-emissive material layer 11 can be determined as follows. For example, a metal plate is pressed against the electron-emissive material layer 11 from the upper side, a total thickness of the base 10 and the electron-emissive material layer 11 is measured, and the thickness of the base 10 is subtracted from the total thickness to determine the thickness of the electron-emissive material layer 11. A suitable weight of the metal plate is about 20 g.

Finally, according to a common method employed for a conventional cathode structure, activation is carried out in which carbonate is decomposed into oxide and part of the oxide is reduced.

EXAMPLE

The present invention is described further in detail by means of an example as follows, but is not limited to the following example.

Cathodes according to the embodiment shown in FIG. 1 were produced while the size of the base (with a circular upper surface) and the area or thickness of the electron-emissive material layer (also with a circular shape) to be sprayed thereon were changed variously.

In order to confirm the relationship between the base surface area A and the electron-emissive material layer area B, cathodes were prepared using five types of electron-emissive material layers formed to have ratios B/A of 1.0, 0.88, 0.62, 0.24, and 0.1 with respect to each of three types of bases having surfaces for layer formation with diameters of 0.1, 0.2, and 0.3 mm, respectively. The bases and the electron-emissive material layers had constant thicknesses of 100 $\mu$m and 65 $\mu$m, respectively.

In order to confirm the relationship between the thickness C of the base and the thickness D of the electron-emissive material layer, cathodes were prepared using three types of electron-emissive material layers formed to have ratios D/C of 0.32, 0.65, and 0.937 with respect to each of three types of bases with thicknesses of 0.1, 0.15, and 0.2 mm, i.e. nine types of cathodes were prepared in total. The surfaces for layer formation of the bases and the electron-emissive material layers had constant diameters of 0.2 mm and 1.6 mm, respectively.

Next, using these cathodes, a three electrode portion in electron guns for 17-inch monitor tubes was assembled and then was sealed in a vacuum tube (with a vacuum of $10^{-7}$ mmHg), and subsequently, the vacuum tube was exhausted. Thus, dummy tubes for evaluation were prepared.

With respect to the dummy tubes thus produced, a life test was conducted under conditions of a cathode temperature of 820° C. and a current led out from the cathode of DC300 $\mu$A. The test conducted under these conditions corresponds to the accelerated life test with respect to a normal operation at 760° C.

First, the influence of the ratio B/A of an electron-emissive material layer area B to a base surface area A on an electron emission characteristic was checked. In this case, the electron emission performance was evaluated using a zero-electric-field saturation current density and cathode cut-off voltage. Their values are described as follows.

Figure 3:
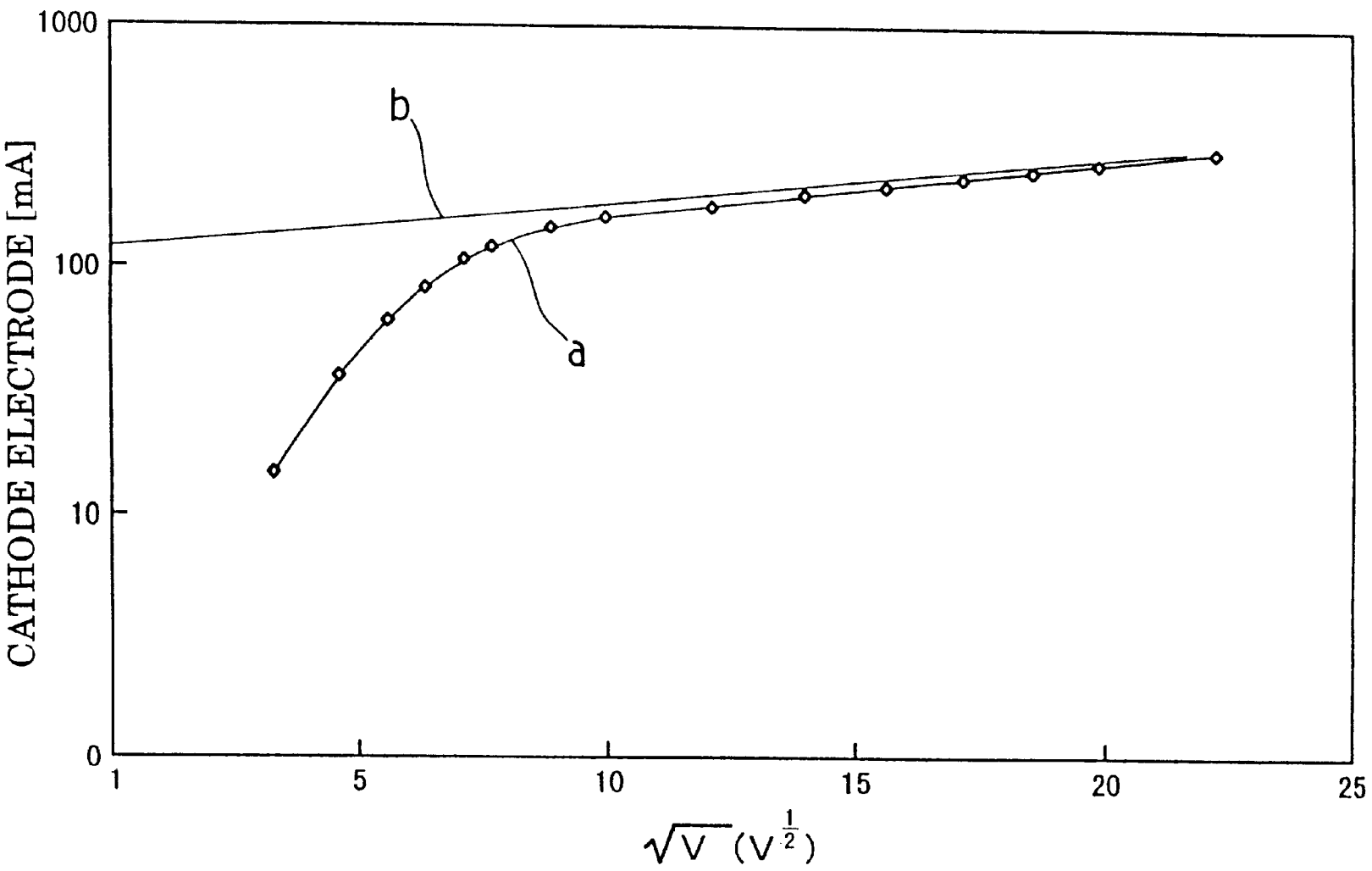
FIG. 3 is a graph showing the relationship between a G1 voltage and a cathode current during an accelerated life test.

FIG. 3 shows the relationship between a pulse voltage applied to a G1 electrode and a cathode current (electron emission) and results obtained by the measurements at a point of 5000 life-hours during a life test, as an example. The "G1 electrode" is an electrode opposing a cathode in the electrode portion and refers to a lead-out electrode for leading out electrons from the cathode in this case.

A curve a in FIG. 3 was obtained by measuring cathode currents flowing upon application of positive pulse voltages to the electrode G1 and plotting logarithms of the cathode currents against square roots of the applied voltages (Schottky plottitng). In a lower range of applied voltages, the cathode current increases sharply with the increase in the G1 voltage. In a range of sufficiently high G1 voltages, the cathode current is saturated and thus is indicated by a straight line. A current value $J_0$ at a G1 voltage of 0 on the straight line b obtained by extrapolation of the straight line portion to the G1 voltage of 0 is referred to as zero-electric-field saturation emission. The zero-electric-field saturation emission indicates the electron emission performance of a cathode itself with the influence of an electric field removed. The value obtained by division of the zero-electric-field saturation emission $J_0$ by the surface area of the electron-emissive material layer is defined as a zero-electric-field saturation current density. The higher the zero-electric-field saturation current density is, the better the electron emission performance of the cathode is.

The "cathode cut-off voltage" refers to the G1 voltage at a time of a cathode current of 0 when voltage is applied to the cathode to drive the triode in a triode operation.

When the zero-electric-field saturation current density is at least 6.4 A/cm$^2$ and the cathode cut-off voltage is not higher than 85% of the initial value after an elapse of 5000 hours in the accelerated life test, excellent performance also is obtained in a normal operation.

Figure 4:
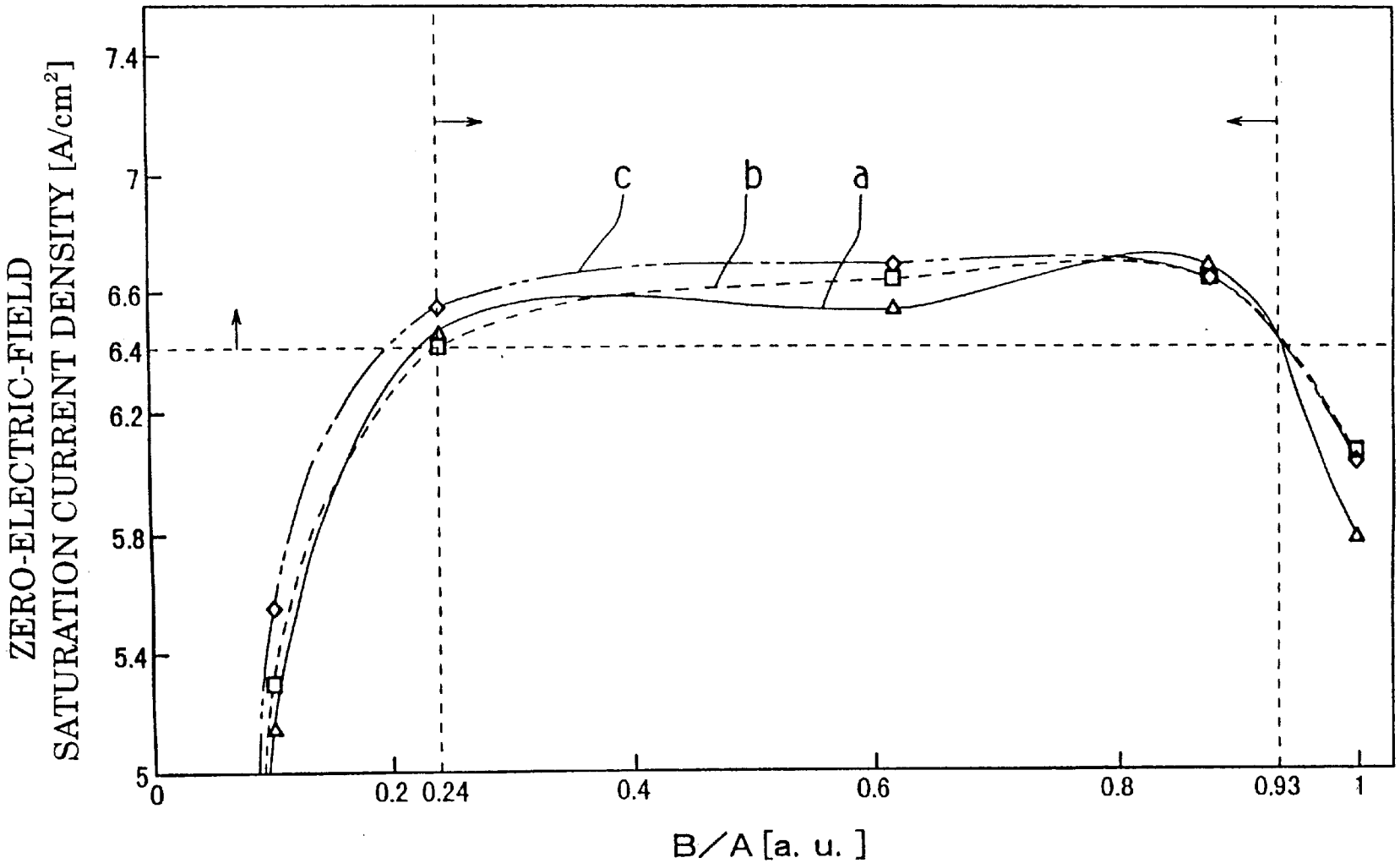
FIG. 4 is a graph showing the relationship between a ratio B/A and a zero-electric-field saturation current density.

FIG. 4 shows the relationship between the ratio B/A and the zero-electric-field saturation current density at a point of 5000 life-hours during a life test.

Curves a, b, and c shown in FIG. 4 indicate the cases using bases with diameters of 0.1 mm, 0.2 mm, and 0.3 mm, respectively. As shown in FIG. 4, a practically sufficient zero-electric-field saturation current density, i.e. at least 6.4 A/cm$^2$ can be obtained using any of the base diameters when the ratio B/A is in the range of 0.24 to 0.93.

The reason can be described as follows.

Figure 5:
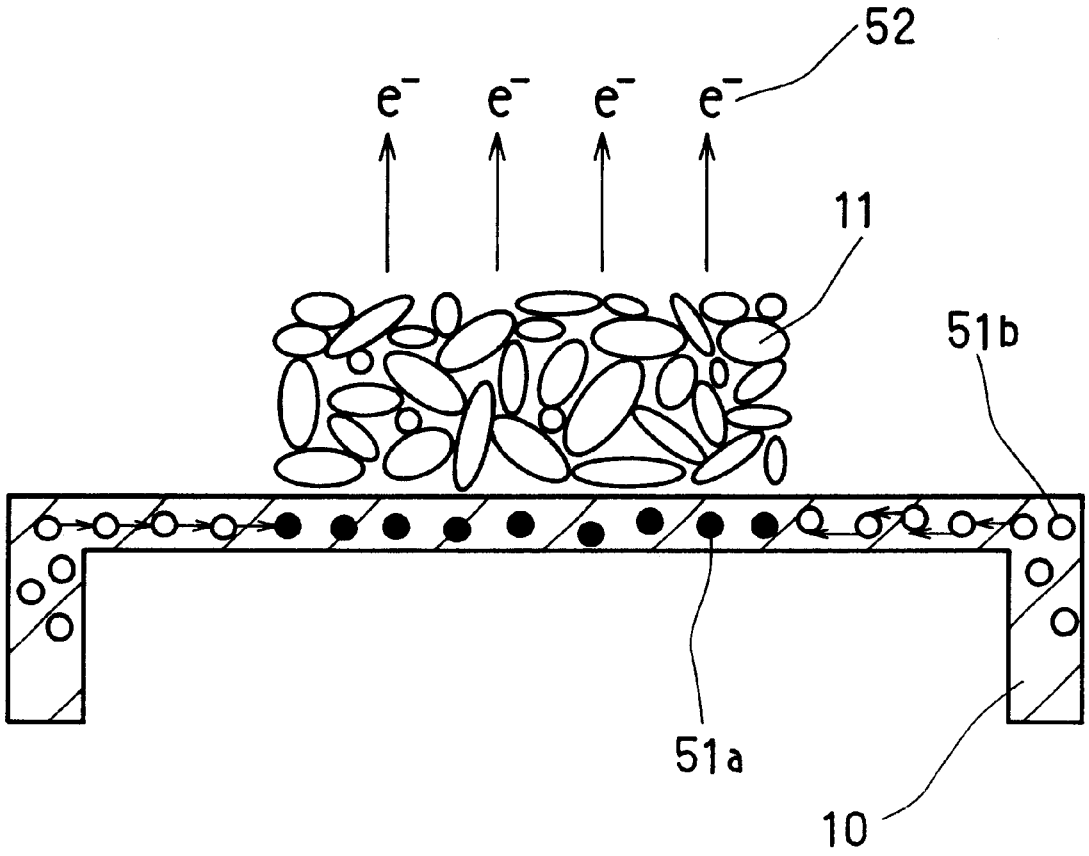
FIG. 5 is a partial schematic sectional view of a cathode structure used for explaining a chemical reaction occurring between a base and an electron-emissive material layer.

FIG. 5 schematically shows a phenomenon occurring inside the base 10 and the electron-emissive material layer 11. When the base 10 is heated with a heater (not shown in the figure), the reducing element (such as magnesium or silicon) contained in the base 10 diffuses due to heat. A reducing element 51*a* present in a portion in contact with the electron-emissive material layer 11 is consumed to reduce the electron-emissive material in the electron-emissive material layer 11. The electron-emissive material thus reduced becomes free barium to produce radiating electrons 52. A reducing element 51*b* present in a portion not in contact with the electron-emissive material layer 11 diffuses according to a concentration gradient of the reducing element in the base 10 to reach the portion in contact with the electron-emissive material layer 11. Thus, the effect of reducing the electron-emissive material layer 11 is improved. Conceivably, such a series of processes progresses suitably when the ratio B/A with respect to the areas in the cathode is within a value range of 0.24 to 0.93.

It was found that the variations in the zero-electric-field saturation current density $\sigma$=5.9 for values outside of the value range described above, the variations in the zero-electric-field saturation current density in the initial period of the life test among cathodes were reduced to about half, namely $\sigma$=2.4, in the value range described above. This is because an excessively high ratio of the contact area B of the electron-emissive material layer to the area A of the base upper surface causes variations in reductive reaction of the reducing element and thus the variations in the initial zero-electric-field saturation current density increase. On the other hand, when the ratio B/A is excessively low, the initial zero-electric-field saturation current density obviously reflects the variations in the areas. When the ratio B/A is set to be within the predetermined range, the chemical reaction progresses with the numbers of the reducing element and barium contained in the electron-emissive material layer being balanced. Thus, the variations in electron emission also can be suppressed.

When the ratio B/A is set to be 0.88 or lower, the zero-electric-field saturation current density is further improved, namely to 6.65 A/cm$^2$. Furthermore, when the ratio B/A is set to be 0.62 or lower, the amount of the electron-emissive material to be used can be reduced considerably and thus the ratio B/A of 0.62 or lower is further preferable in view of the cost reduction.

When the ratio B/A is set to be at least 0.35, no change in equipment is required during the manufacture and in addition, the emitter can be prevented from being peeled off. Thus, the quality further improves. Moreover, when the ratio B/A is set to be at least 0.40, the lifetime before reaching the life end regulation (a cut-off variation of −10% and an emission dropping rate of 30%) can be prolonged. Therefore, it is particularly preferable to set the ratio B/A to be at least 0.40.

Next, the influence of the ratio D/C of the thickness D of the electron-emissive material layer to the thickness C of the base on the electron emission characteristic was checked.

Figure 6:
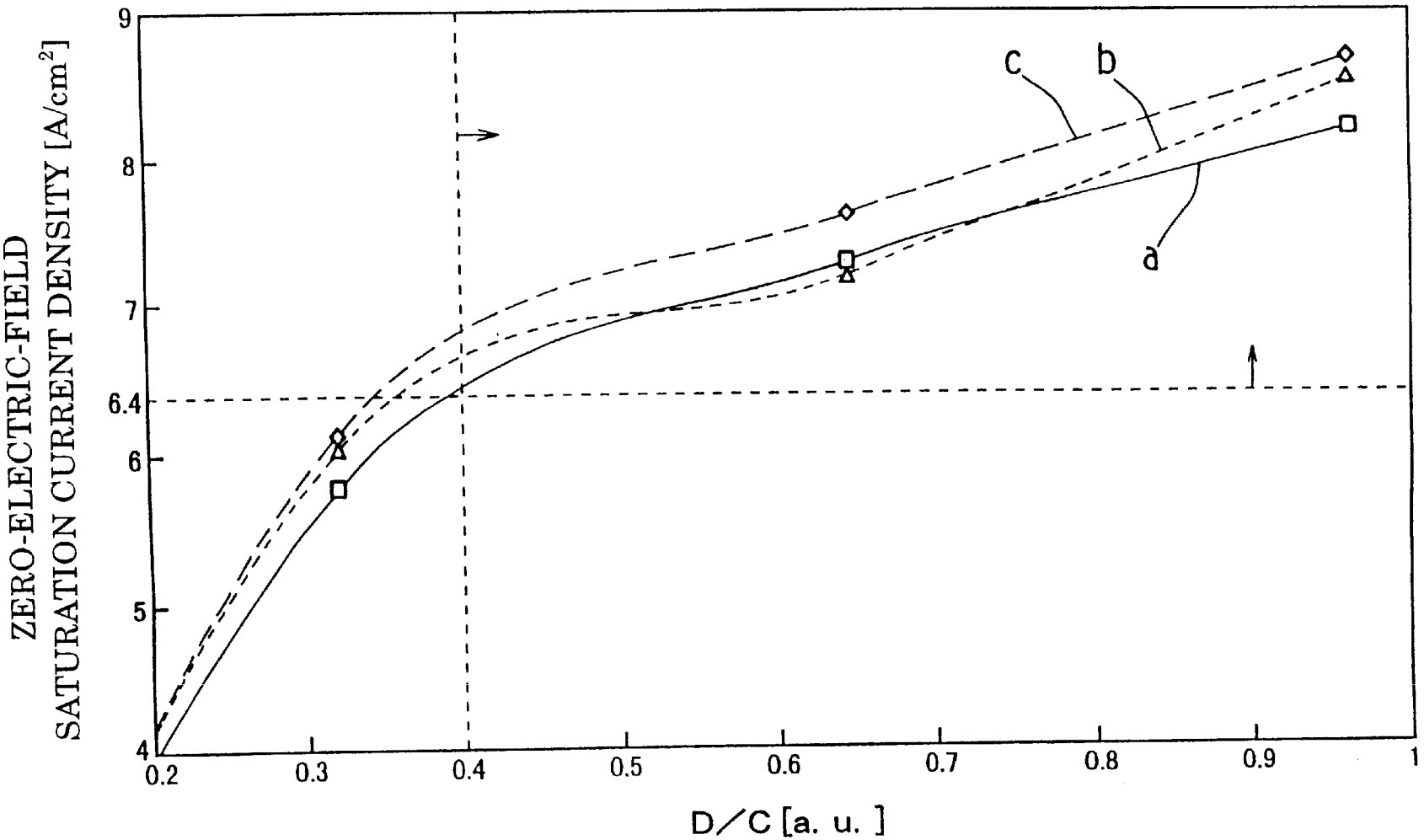
FIG. 6 is a graph showing the relationship between a ratio D/C and a zero-electric-field saturation current density.

FIG. 6 shows the relationship between the ratio D/C and the zero-electric-field saturation current density after an elapse of 5000 hours (5000 life-hours) in the life test.

Curves a, h, c shown in FIG. 6 indicate cases using bases with thicknesses of 0.1 mm, 0.15 mm, and 0.2 mm, respectively. As shown in FIG. 6, a zero-electric-field saturation current density of at least 6.4 A/cm$^2$ can be obtained at a point of 5000 life-hours when the ratio D/C is at least 0.4. The ease of causing the reductive reaction is proportional to the ratio of the number of the reducing element to that of barium in the electron-emissive material layer. Hence, an excessively low ratio D/C results in less reductive reaction and thus the electron emission is reduced.

Figure 7:
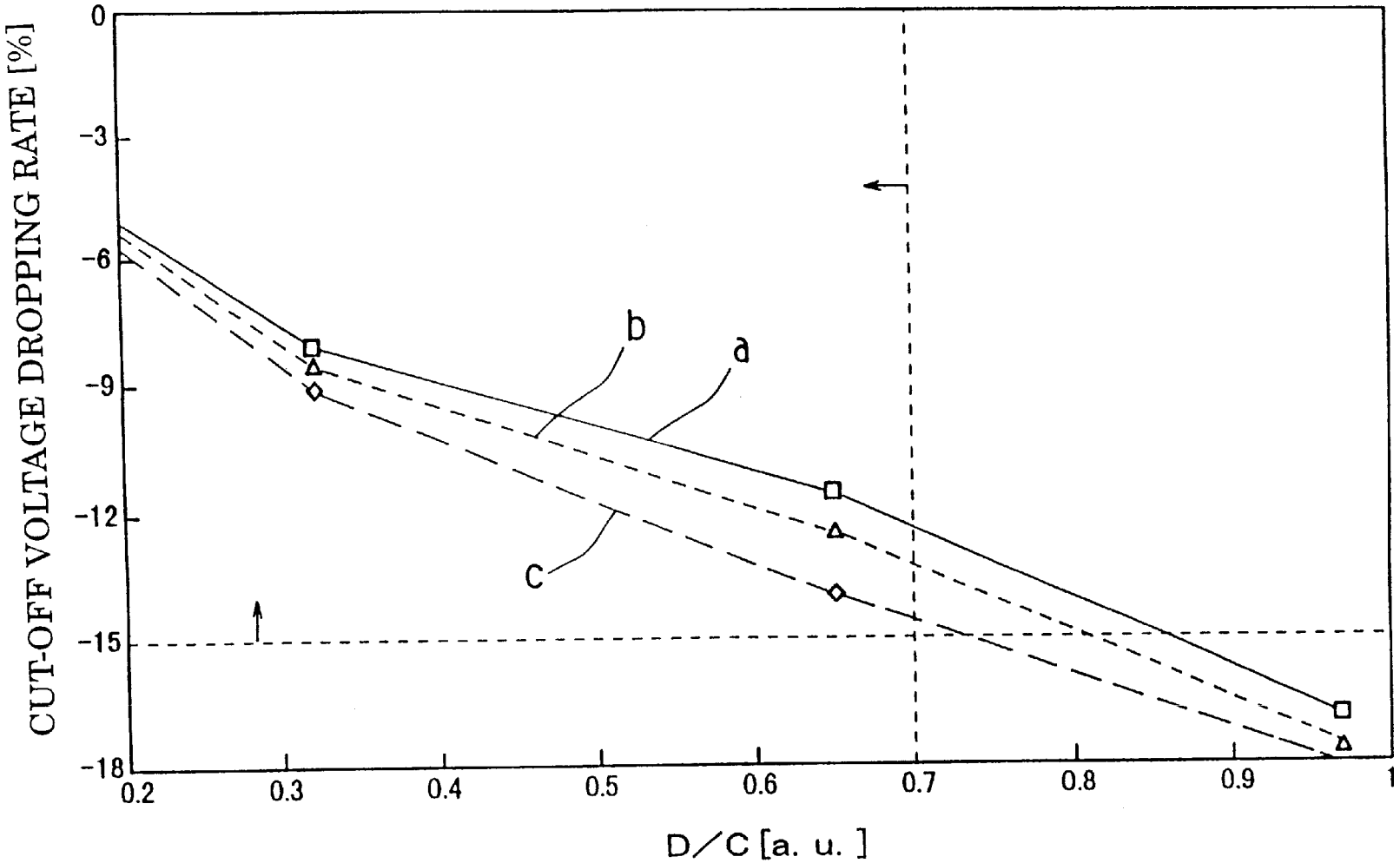
FIG. 7 is a graph showing the relationship between a ratio D/C and a cut-off voltage dropping rate.
Figure 8:
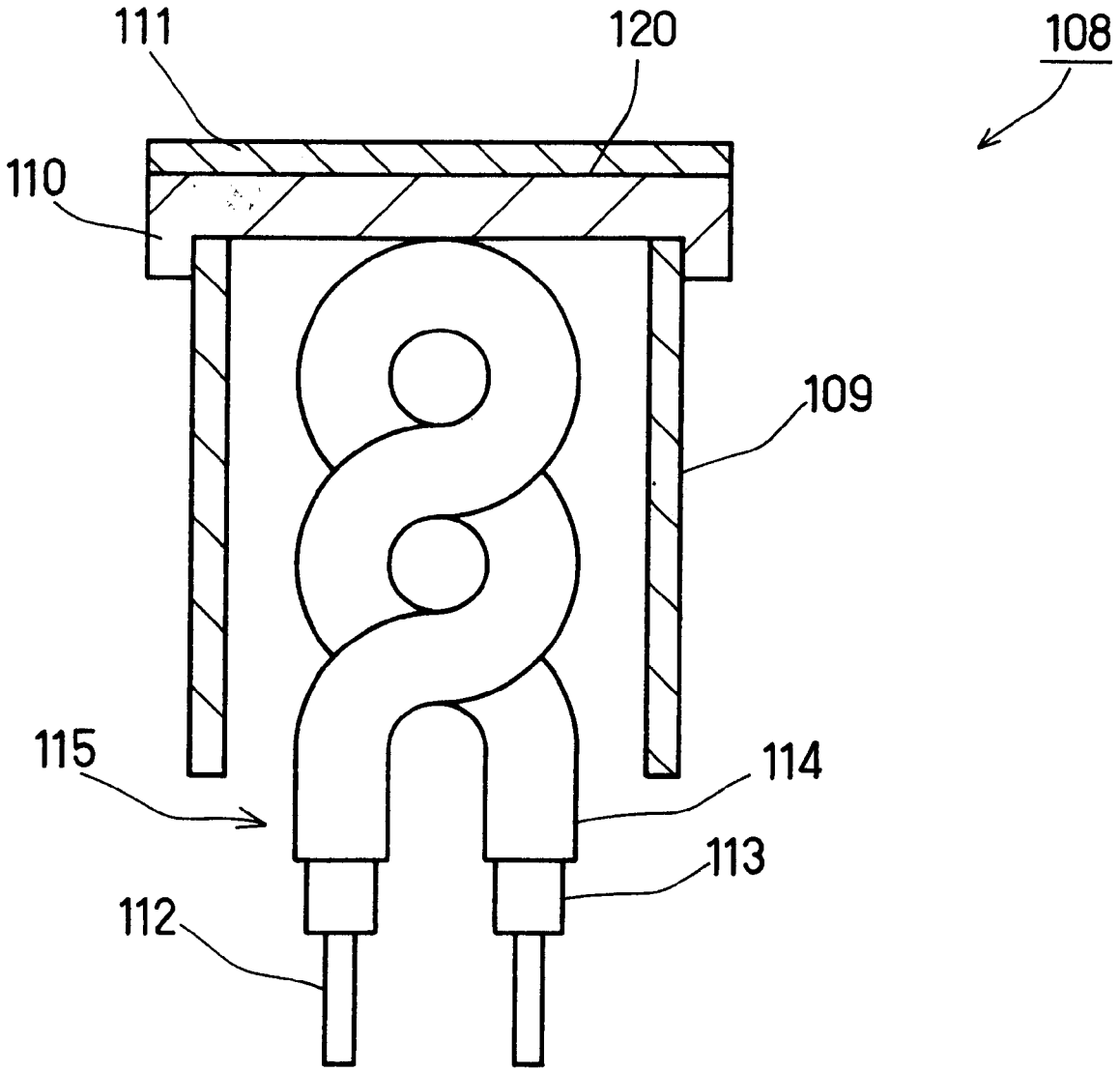
FIG. 8 is a sectional view of an embodiment of a conventional cathode structure.

FIG. 7 shows the relationship between the ratio D/C and the cut-off voltage dropping rate again at a point of 5000 life-hours. Curves a, b, and c shown in FIG. 7 indicate cases using bases with thicknesses of 0.1 mm, 0.15 mm, and 0.2 mm, respectively. As shown in FIG. 7, when the ratio D/C is set to be 0.7 or lower, the cut-off voltage is within −15%, i.e. a value of at least 85% of the initial value can be secured.

According to the investigation by the inventor, the electron-emissive material layer shrinks during operation in proportion to its thickness due to the reductive reaction. When the ratio D/C increases, the thickness of the electron-emissive material layer increases relatively and thus the shrinkage increases during the operation. Consequently, the variations in the cut-off voltage increase. Preferably, therefore, the ratio D/C is a predetermined value or lower to prevent the electron emission performance from degrading.

From the results shown in FIGS. 6 and 7, it was confirmed that a preferable ratio D/C is 0.4 to 0.7.

INDUSTRIAL APPLICABILITY

As described above, according to the present invention, electron-emissive material layers with optimum sizes can be provided corresponding to variously sized bases, and a long-life cathode structure also can be provided in which variations in the zero-electric-field saturation current density among cathodes and in the cut-off voltage are small. When the size of the base is determined, the size of the electron-emissive material layer required for the practical operation can be determined easily. Therefore, the cathode structure can be designed easily and quickly. Thus, the present invention has a high industrial utility value in the technical field of the cathode-ray tube.

What is claimed is:

1. A cathode structure for a cathode-ray tube, comprising a base containing a reducing element and an electron-emissive material layer formed on the base, wherein the cathode structure satisfies a relationship of $0.24 \leqq B/A \leqq 0.93$, where A denotes an area of a surface for layer formation of the base and B represents an area where the base and the electron-emissive material layer are in contact with each other, and has a zero-electric-field saturation current density of at least 6.4 A/cm$^2$ after an implementation of an accelerated life test for 5000 hours under conditions of a vacuum of $10^{-7}$ mmHg, a cathode temperature of 820° C., and a current led out from a cathode of DC 300 $\mu$A.

2. The cathode structure for a cathode-ray tube according to claim 1, wherein $B/A \leqq 0.88$.

3. The cathode structure for a cathode-ray tube according to claim 1, wherein $B/A \geqq 0.35$.

4. The cathode structure for a cathode-ray tube according to claim 1, wherein the cathode structure satisfies a relationship of $0.4 \leqq D/C \leqq 0.7$, where C and D denote thicknesses of the base and the electron-emissive material layer, respectively.

5. The cathode structure for a cathode-ray tube according to claim 1, wherein an application liquid is sprayed with a frame, having an opening corresponding to a portion where the electron-emissive material layer is to be formed, placed on the base, so that the electron-emissive material layer is formed on a part of the surface of the base.

6. The cathode structure for a cathode-ray tube according to claim 1, wherein the cathode structure has a cathode cut-off voltage of at least 85% of an initial value after the implementation of the accelerated life test for 5000 hours.

* * * * *